United States Patent [19]

Harris et al.

[11] 3,986,149

[45] Oct. 12, 1976

[54] HIGH POWER RECIPROCAL CO-PLANAR WAVEGUIDE PHASE SHIFTER

[75] Inventors: Douglas H. Harris, Dayton, Ohio; Fred J. Rosenbaum, Clayton, Mo.

[73] Assignee: The United States of America as represented by the Secretary of the Air Force, Washington, D.C.

[22] Filed: Aug. 29, 1975

[21] Appl. No.: 608,955

[52] U.S. Cl. ..... 333/31 R; 333/24.1

[51] Int. Cl.[2] ..... H01P 1/18

[58] Field of Search ..... 333/1.1, 24.1, 24.2, 333/31 R

[56] References Cited

UNITED STATES PATENTS 3,560,893 2/1971 Wen ..... 333/24.1

3,602,845 8/1971 Agrios et al. ..... 333/24.1

*Primary Examiner*—Paul L. Gensler

*Attorney, Agent, or Firm*—Joseph E. Rusz; Henry S. Miller

[57] ABSTRACT

A rectangular toroid of a substrate material has a ferrite arc plasma sprayed into a channel toroid leaving two faces exposed. An off center aperture receives a drive winding which surrounds one long side of the toroid, the other long side is covered by three co-planar and parallel metal strips, slightly spaced and having ferrite material between the strips and forming a co-planar surface with the metal strips.

4 Claims, 2 Drawing Figures

HIGH POWER RECIPROCAL CO-PLANAR WAVEGUIDE PHASE SHIFTER

STATEMENT OF GOVERNMENT INTEREST

The invention described herein may be manufactured and used by or for the Government for governmental purposes without the payment of any royalty thereon.

BACKGROUND OF THE INVENTION

This invention relates generally to a high power reciprocal waveguide phase shifter and more particularly to such a waveguide phase shifter that is also co-planar.

A substantial amount of information has become available in the recent past regarding various methods and means for the phase shifting of microwave energy. One particular design of phase shifter utilizes a strip transmission line on one side of a dielectric substrate with a ground plane conductor on the opposite surface of the substrate. Modifications of this design have provided a coplanar device wherein the transmission line has a ground conductor in a parallel spaced-apart relationship in the same plane. In this design both lines are in the same plane, usually positioned on a ferrite material.

Further, in this type structure, generally the applied magnetization field is coplanar with the transmission line. There results then, a poor distribution of the applied magnetizing field about the microwave transmission line or strip, and in neither state are the fields of applied magnetization exactly parallel or perpendicular to the direction of propagation of microwave energy.

From this evolved many different devices using various shapes and layers of materials in an attempt to make the device reciprocal and latching. These changes and modifications have resulted in the availability of a number of low power, complex and expensive phase shifters.

SUMMARY OF THE INVENTION

These and other defects of prior art reciprocal ferrite film latching phase shifters are overcome by the phase shifter of the invention.

The invention presented provides a phase shifter with a high power capability, improved ferrite interaction and latching capability in planar geometry by the use of ferrite regions which maintain a switchable geometry.

Utilizing the toroidal configuration of rectilinear dimensions and an aperture offset so as to be adjacent one long side of the toroid, a cavity of substrate material has deposited therein a suitable ferrite material. Passing through the aperture and around the long side of the toroid is a drive winding creating a switching yoke. The magnetization is parallel with the propagation of the wave rendering the device reciprocal.

On the second long side are located the microstrip lines, consisting of a narrow transmission line and two wider ground planes parallel to the transmission line and spaced slightly away therefrom. Between the transmission line and ground planes in the space provided are a pair of ferrite ribs, coplanar with the adjacent transmission line and ground plane, forming a reaction strip.

The cross sectional area of all positions of the switching yoke is equal to or greater than the cross-sectional area of the reaction strip, including the ferrite ribs between metallizations. Increased interaction is gained by further reduction of the gap widths but arc-over between the conductors is prevented by the included ferrite.

The transverse state of remanent magnetization of the ferrite, essential for latching, is found to be inherent in the design and shape of the toroid and is accomplished without the need for additional magnetic fields or windings.

It is therefore an object of the invention to provide a new and improved waveguide phase shifter.

It is another object of the invention to provide a new and improved waveguide phase shifter that is of co-planar design.

It is a further object of the invention to provide a new and improved waveguide phase shifter that is coplanar in design and reciprocal in function.

It is still another object of the invention to provide a new and improved coplanar waveguide phase shifter that has a high power capability.

It is still a further object of the invention to provide a new and improved co-planar waveguide phase shifter that has improved ferrite interaction over any known similar device.

It is another object of the invention to provide a new and improved co-planar waveguide phase shifter that has self latching characteristics.

It is another object of the invention to provide a new and improved co-planar waveguide phase shifter that is simple in design and easily fabricated.

It is another object of the invention to provide a new and improved co-planar waveguide phase shifter that is low in cost and high in reliability.

These and other advantages, features and objects of the invention will become more apparent from the following description taken in connection with the illustrative embodiment in the accompanying drawing.

DESCRIPTION OF THE PREFERRED EMBODIMENT

Figure 1:
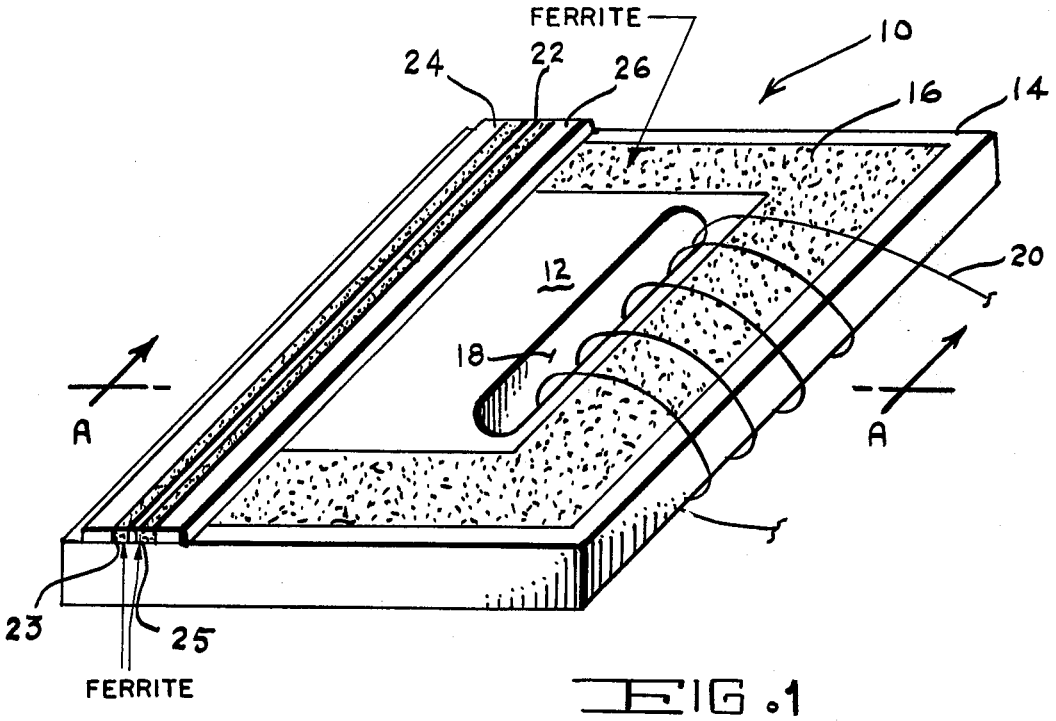
FIG. 1 is a perspective view of the invention.

Referring now to FIG. 1, the high power, reciprocal coplanar waveguide phase shifter is shown generally at 10. A rectilinearily shaped toroid substrate cavity having an inner region 12 and outer region 14 has deposited therein a suitable ferrite 16. It has been found that depositing of the film by the arc plasma spray process is a very satisfactory method. The inner portion of the substrate 12 has an elongated eliptically shaped aperture 18 extending parallel and in proximity to one long side of the toroid. Passing through the aperture and around the ferrite filled cavity is a coil 20 utilized for generating electromagnetic fields and forming a switching yoke. Due to the position and nature of the coil the device is switchable in the longitudinal direction yielding reciprocal phase shift.

The opposite long side of the toroid has mounted thereon a narrow microstrip transmission line 22 deposited on the surface of the ferrite 11. Adjacent, but spaced from the transmission line on either side in a parallel relationship are a pair of wide ground plane conductors 24 and 26.

Between each ground plane conductor and the transmission line is a ridge 23, 25 of ferrite material co-planar with the conductors.

Each rib may be formed by applying a suitable mask over the metallization and arc plasma spraying the interval with the ferrite material.

Figure 2:
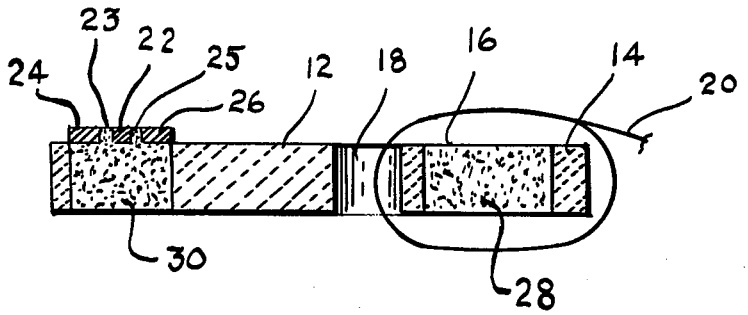
FIG. 2 is a cross-sectional view of the invention taken along line A—A′ of FIG. 1.

FIG. 2 shows the inner substrate 12 and outer substrate 14 containing the ferrite 16. The aperture 18 containing the coil 20 that surrounds the switching yoke 28 and having a larger cross section area then the reaction strip 30. Transmission line 22 is flanked immediately by ferrite ridges 23 and 25 and then by ground planes 24 and 26.

In operation switching is performed conventionally by applying an appropriate current to the coil 20 creating a longitudinal magnetic field in the direction of propagation of the wave and thereby providing reciprocal switching. The ferrite becomes transversely magnetized creating remanent magnetization and latching the phase shifter.

It should be understood of course, that the foregoing disclosure relates to only a preferred embodiment of the invention and that numerous modifications or alterations may be made therein without departing from the spirit and scope of the invention as set forth in the appended claims.

What is claimed is:

1. A high power co-planar waveguide phase shifter comprising; a rectangular toroid of ferrite material; shell of substrate material encasing said ferrite along its outer surface; a block of substrate material filling the area within the toroid; an elongated ellipically shaped aperture in said block of substrate material parallel with one side of the toroid; a coil surrounding one side of the toroid and passing through the aperture; a microstrip transmission line positioned on the surface of said ferrite; a plurality of ground plane conductors mounted on said ferrite and in a parallel, spaced apart relationship with said transmission line to form a coplanar waveguide and a plurality of ferrite ribs extending from said ferrite toroid to the surface of said transmission line, between said transmission line and said ground plane conductors.

2. A high power co-planar waveguide phase shifter according to claim 1 wherein said plurality of ground plane conductors includes two ground plane conductors positioned in the same plane, one on either side of the transmission line.

3. A high power co-planar waveguide phase shifter according to claim 1 wherein said transmission line is positioned on the surface of the long side of the toroid opposite from the said coil.

4. a high power co-planar waveguide phase shifter according to claim 1 wherein the cross sectional area of the ferrite toroid within the said coil is greater than the cross sectional area of the ferrite supporting the transmission line.

* * * * *